US012163450B2

(12) United States Patent
Hettich

(10) Patent No.: US 12,163,450 B2
(45) Date of Patent: Dec. 10, 2024

(54) RESONATOR CORE WITH SPIRAL SLITS

(71) Applicant: Connor James Hettich, Buffalo, NY (US)

(72) Inventor: Connor James Hettich, Buffalo, NY (US)

( * ) Notice: Subject to any disclaimer, the term of this patent is extended or adjusted under 35 U.S.C. 154(b) by 0 days.

(21) Appl. No.: 17/661,114

(22) Filed: Apr. 28, 2022

(65) Prior Publication Data

US 2023/0349308 A1 Nov. 2, 2023

(51) Int. Cl.
*F01N 1/02* (2006.01)

(52) U.S. Cl.
CPC ..... *F01N 1/02* (2013.01)

(58) Field of Classification Search
CPC ... F01N 1/02; F01N 1/026; F01N 1/04; F01N 1/12; F01N 2470/02; F01N 2470/04
See application file for complete search history.

(56) References Cited

U.S. PATENT DOCUMENTS 1,861,775 A * 6/1932 Aseltine ..... F01N 1/08 181/267
2,024,834 A * 12/1935 Rippe ..... F01N 1/088 181/262
2,088,296 A * 7/1937 Riethmiller ..... F01N 1/02 181/250
2,125,449 A * 8/1938 Riethmiller ..... F01N 1/084 181/266
2,148,948 A * 2/1939 Riethmiller ..... F01N 1/02 181/250
2,191,620 A * 2/1940 Muller ..... F01N 13/18 181/250
2,338,347 A * 1/1944 Mccurdy ..... F01N 1/12 181/253
4,140,204 A * 2/1979 Wilson ..... F01N 1/08 181/269
4,184,565 A * 1/1980 Price ..... F01N 1/10 181/252
4,234,054 A * 11/1980 Chapin ..... F01N 1/24 181/252
4,284,133 A * 8/1981 Gianni ..... F28F 13/12 62/527
4,325,459 A * 4/1982 Martin ..... F01N 1/24 181/252
6,116,377 A * 9/2000 Dugan ..... F01N 1/08 181/251

(Continued)

FOREIGN PATENT DOCUMENTS

CN 112049710 A * 12/2020 ..... F01N 1/02
JP 11324658 A * 11/1999
WO WO-9535435 A1 * 12/1995 ..... F01N 1/08

*Primary Examiner* — Jeremy A Luks
(74) *Attorney, Agent, or Firm* — Dunlap Bennett & Ludwig, PLLC

(57) ABSTRACT

A vehicular resonator system comprising has a cylindrical core housed within an outer body. An insulation layer is between the cylindrical core and the outer body. The cylindrical core is comprised of a plurality of spiral slits proximate to a first end of the cylindrical core and traversing the cylindrical core. The cylindrical core further comprises a spiral reinforcement rib proximate the first end of the cylindrical core and traversing the cylindrical core. The spiral slits reduce weight of the core as well as noise and physically sensed vibration.

5 Claims, 3 Drawing Sheets

(56) References Cited

U.S. PATENT DOCUMENTS

| | | | | |
|---|---|---|---|---|
| 6,679,351 | B2 * | 1/2004 | Cummings | F01N 1/088 181/212 |
| 6,715,581 | B2 * | 4/2004 | Dooley | F01N 1/006 181/227 |
| 6,889,500 | B1 * | 5/2005 | Martinez | F01N 1/12 60/312 |
| 8,234,859 | B2 * | 8/2012 | Shirra | F01N 1/10 60/274 |
| D972,476 | S * | 12/2022 | Gromova | D12/194 |
| 2018/0230887 | A1 * | 8/2018 | Martinez | F01N 1/12 |

* cited by examiner

RESONATOR CORE WITH SPIRAL SLITS

BACKGROUND OF THE INVENTION

The present invention relates to resonators and, more particularly, to a resonator core with spiral slits.

Exhaust systems have multiple components that can restrict flow of exhaust gases, dampen sound waves, and change sound levels. When these components are removed for performance, they are commonly replaced with resonators to decrease unwanted back pressure and increase exhaust gas flow. This can cause drone, a resonance in the car, and vibrations throughout the vehicle.

Perforated resonator cores offer some noise reduction while minimizing a sacrifice in performance. They produce exhaust drone which is common with standard resonator cores and can cause vibrations throughout a vehicle. Most perforated resonator cores sound equal to each other when being used in the same application.

Presently, cores are constructed using perforated sheet metal. These perforation help reduce noise. Standard perforated resonator cores reduce sound levels and drone to an extent. Extending a length of the core further reduces the sound levels and drone. However, extending the length adds unwanted weight and makes it harder to fit the core in tight spaces under a vehicle.

Standard resonators are offered in multiple sizes. Generally, people choose a smaller option for weight and looks. These smaller options are not as capable of reducing noise and drone. While larger options may more effectively reduce noise and drone, they are also associated with lower performance of the vehicle.

As can be seen, there is a need for a compact and light-weight resonator that sufficiently reduces noise and drone without sacrificing performance of the vehicle.

SUMMARY OF THE INVENTION

In one aspect of the present invention, a vehicular resonator system comprises a cylindrical core with a plurality of spiral slits beginning proximate a first end of the cylindrical core and traversing the cylindrical core. The cylindrical core further comprises a spiral reinforcement rib proximate the first end of the cylindrical core and traversing the cylindrical core.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims with reference to the drawings.

A general overview of the various features of the invention will be provided, with a detailed description following. Broadly, an embodiment of the present invention provides a vehicular resonator system with a core that includes slits to reduce sound and physical sensed vibration.

The present invention reduces high decibel levels of car exhaust systems while retaining a compact size. The present invention may reduce the size of a standard resonator in half and reduce its weight as well.

The present invention comprises a hollow core. The core may be cylindrical. The core may be incorporated into a resonator or muffler system to reduce sound and physical sensed vibration simultaneously. The slits in the present invention reduce sound and physical sensed vibration which is caused by vibrations while minimally reducing a sacrifice in performance of the vehicle.

The present invention enables gases to flow through the exhaust system without interference while maintaining a low exhaust decibel level. An exhaust gas may enter a first end of the core and exit through a second end of the core.

The core may be composed of and/or cut out of stainless-steel tubing using a Computer Numerical Control ("CNC") laser cutting machine.

The core may be welded into a resonator or muffler chamber. The core may be interchanged with a standard perforated core during a manufacturing of a resonator.

Figure 1:
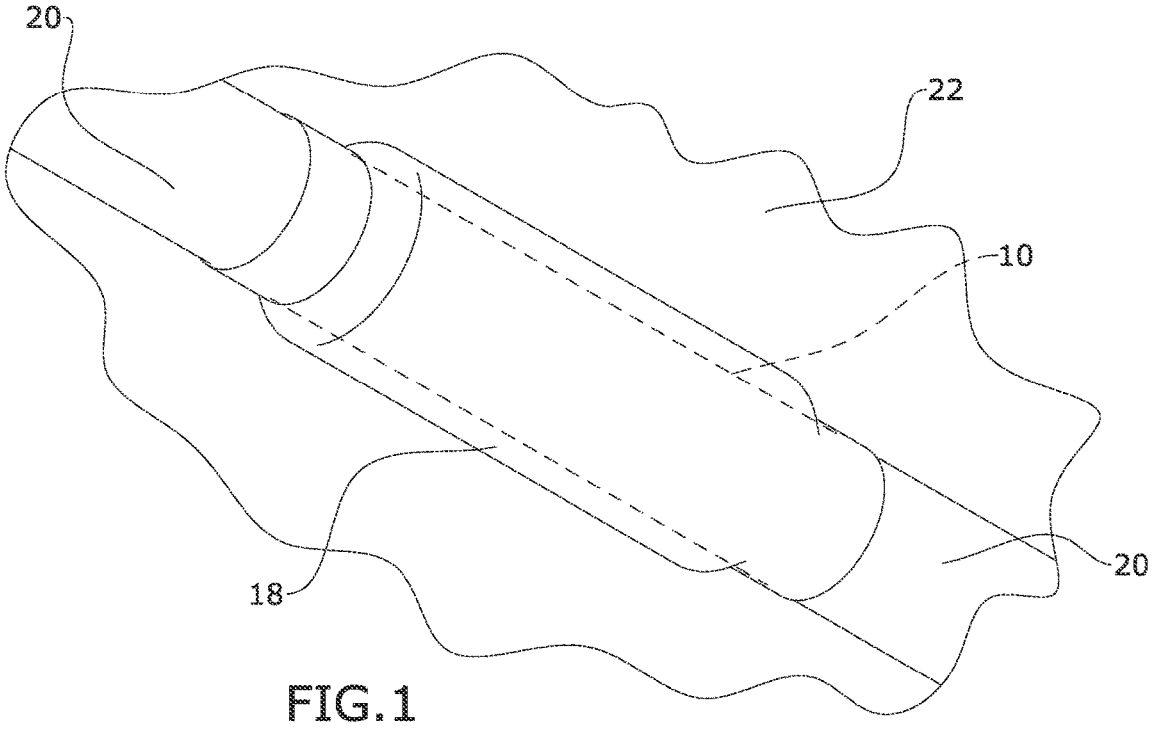
FIG. 1 is a perspective view of a resonator core according to an embodiment of the present invention, shown in use within a resonator outer body.

Referring to Figures, FIG. 1 shows the present invention in use. A core is installed onto an exhaust system 20 in a car 22. The core 10 is housed inside of an outer body 18.

Figure 2:
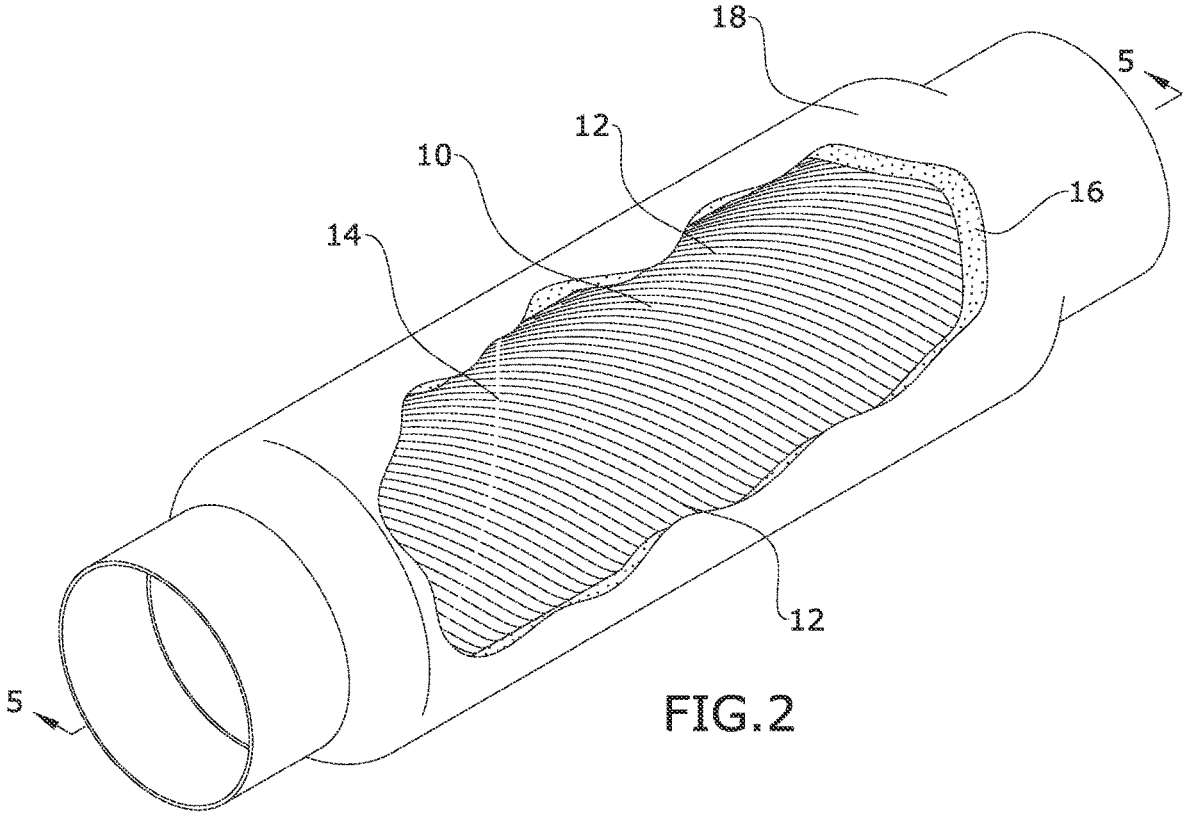
FIG. 2 is a partially cutaway perspective view thereof.
Figure 3:
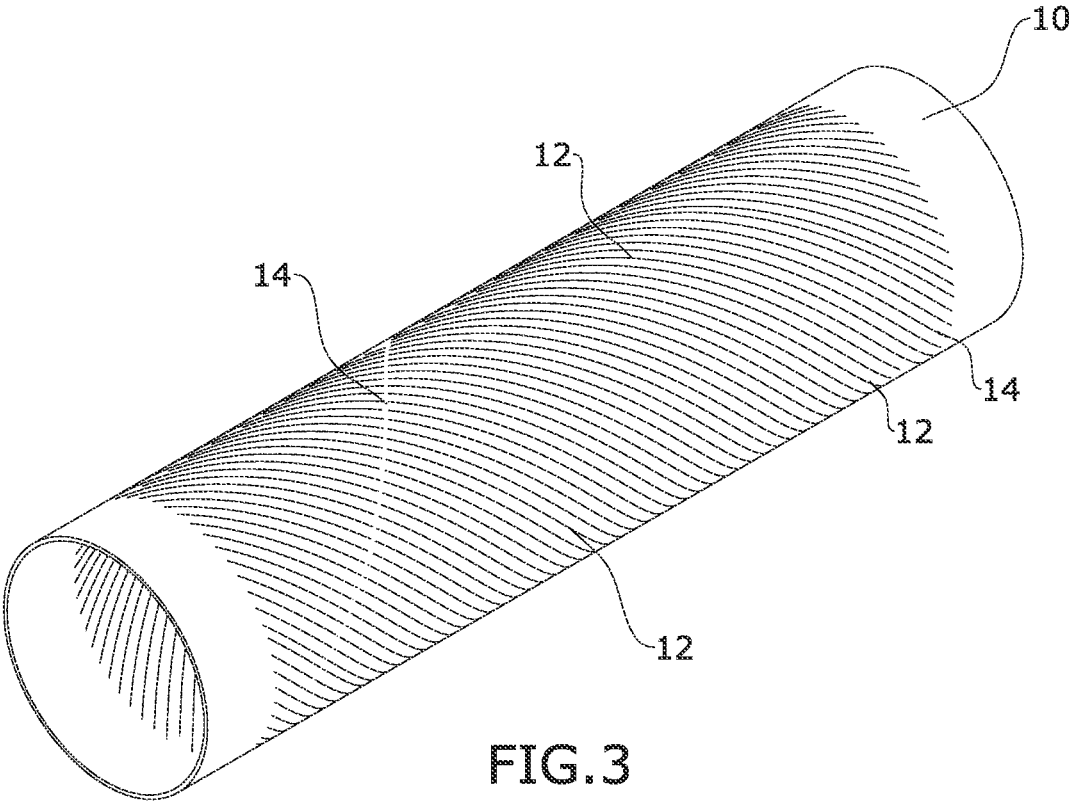
FIG. 3 is a perspective view of the core thereof.
Figure 4:
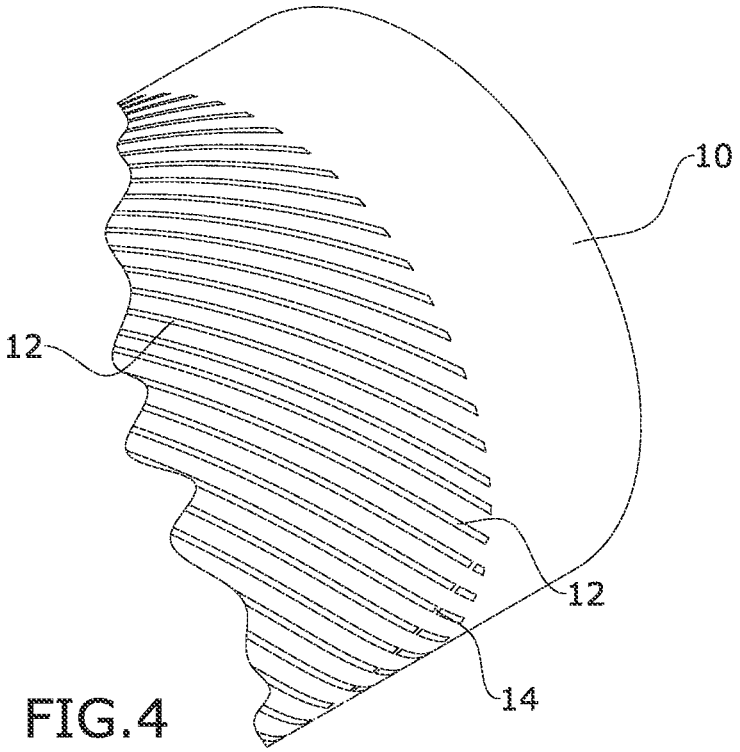
FIG. 4 is a detail view thereof.

FIG. 2 shows the core 10 inside of the outer body 18. An insulating layer 16 is interposed between the core 10 and the outer body 18. The insulating layer 16 may help reduce sound and physical sensed vibration. The insulating layer 16 may be fiber glass or another sound dampening material. As shown in FIG. 3, the core is hollowed and cylindrical. The core 10 comprises a plurality of slits 12 perforating the core 10 and proximate a first end of the core 10. The slits 12 traverse the core counterclockwise in a spiral fashion until ending at a second end of the core 10. Each end of the core 10 includes an intact margin with no slits 12. A reinforcement rib 14 forms a non-perforated portion of the core 10. The reinforcement rib 14 begins at the first end of the core 10 and traverses the core 10 clockwise in a spiral fashion until ending at the second end of the core 10. FIG. 4 offers a detail view of the slits 12 and the reinforcement rib 14. In some embodiments of the present invention, the slits 12 may traverse the core 10 clockwise, and the reinforcement rib 14 may traverse the core 10 counterclockwise. In some embodiments of the present invention, there may be a plurality of reinforcement ribs 14.

Figure 5:
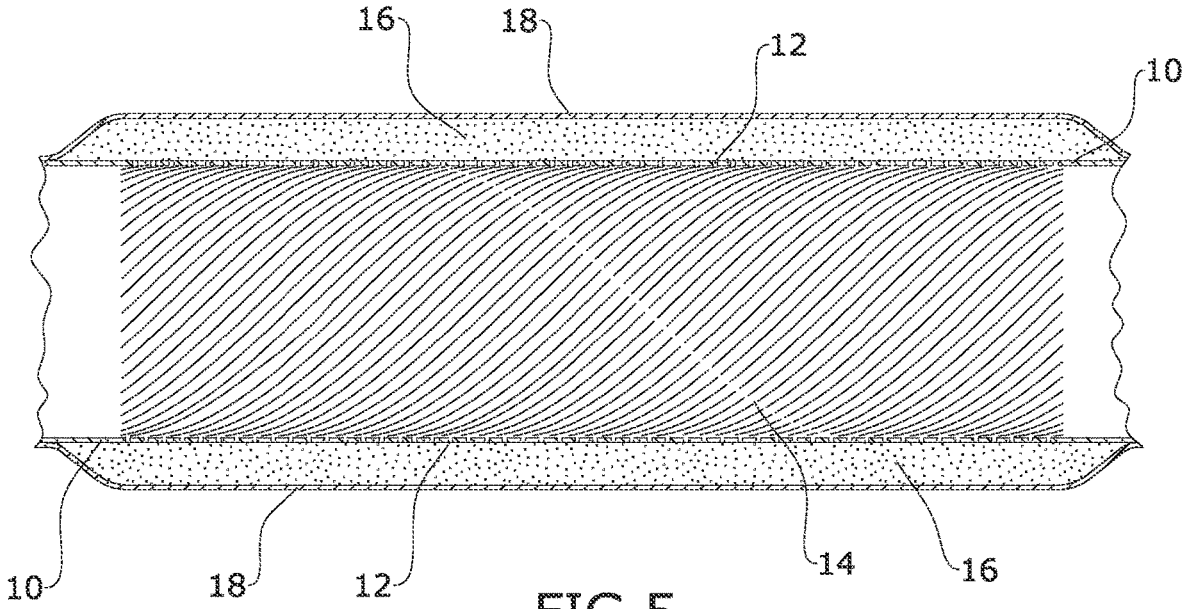
FIG. 5 is a cross sectional view thereof, taken on the line 5-5 of FIG. 2.

FIG. 5 is a cross sectional view of the core 10 within the outer body 18.

It should be understood, of course, that the foregoing relates to exemplary embodiments of the invention and that modifications may be made without departing from the spirit and scope of the invention as set forth in the following claims.

What is claimed is:

1. A vehicular resonator system comprising:

an outer body;

a cylindrical core housed within the outer body;

the cylindrical core comprising:

a. a plurality of spiral slits beginning proximate a first end of the cylindrical core and traversing the cylindrical core to proximate a second end of the cylindrical core; and b. a unitary continuous spiral reinforcement rib proximate the first end of the cylindrical core and traversing the cylindrical core, wherein each of the plurality of spiral slits is continuous from the first end to the second end but for the spiral reinforcement rib; and an insulation layer interposed between the cylindrical core and the outer body.

2. The vehicular resonator system of claim 1, wherein the plurality of spiral slits traverses the cylindrical core counterclockwise and the spiral reinforcement rib traverses the cylindrical core clockwise.

3. The vehicular resonator system of claim 1, wherein the plurality of spiral slits traverses the cylindrical core clockwise and the spiral reinforcement rib traverses the cylindrical core counterclockwise.

4. The vehicular resonator system of claim 1, wherein the cylindrical core is hollow.

5. The vehicular resonator system of claim 4, wherein an inner surface of a lumen of the cylindrical core has a uniform circumference from the first end to the second end.

* * * * *